United States Patent [19]

Krumme

[11] Patent Number: 4,621,882

[45] Date of Patent: Nov. 11, 1986

[54] THERMALLY RESPONSIVE ELECTRICAL CONNECTOR

[75] Inventor: John F. Krumme, Woodside, Calif.

[73] Assignee: Beta Phase, Inc., Menlo Park, Calif.

[21] Appl. No.: 801,516

[22] Filed: Nov. 26, 1985

Related U.S. Application Data

[63] Continuation of Ser. No. 609,747, May 14, 1984, abandoned.

[51] Int. Cl.[4] ..... H01R 13/20

[52] U.S. Cl. ..... 339/30; 339/DIG. 1; 339/61 M

[58] Field of Search ..... 339/30, DIG. 1, 59, 339/176 MF, 17 F

[56] References Cited

U.S. PATENT DOCUMENTS

| | | | |
|---|---|---|---|
| 3,569,901 | 3/1971 | Connor | 339/30 |
| 3,727,173 | 4/1973 | Goldmann et al. | 339/DIG. 1 |
| 3,740,839 | 6/1973 | Otte et al. | 339/30 |
| 3,913,444 | 10/1975 | Otte | 339/30 |
| 4,487,465 | 12/1984 | Cherian | 339/75 R |

OTHER PUBLICATIONS

Ujifusa, Low-Cost-Low Resistance, Quick-Disconnect Connector, p. 1988, IBM Bulletin, vol. 14, No. 7, Dec. 1971.

*Primary Examiner*—Gil Weidenfeld
*Assistant Examiner*—Paula A. Austin
*Attorney, Agent, or Firm*—Burns, Doane, Swecker & Mathis

[57] ABSTRACT

A common problem in the art of connecting two electrical components is the providing of a convenient and effective zero insertion force coupling therebetween especially where a plurality of parallel conductors along one component are to be connected with a corresponding plurality along the other. The present apparatus and method address this problem by providing a split tube edge along one of the two electrical components, the split tube including a memory shape material therein. When the split tube is opened, the second electrical component is inserted therein whereupon the split tube can be closed. Conductors along the split tube make contact with corresponding conductors along the second component when the tube is closed. The memory shape material in the split tube acts to either open the split tube or close the split tube when the material reaches a characteristic transition temperature.

11 Claims, 11 Drawing Figures

THERMALLY RESPONSIVE ELECTRICAL CONNECTOR

This is a continuation of application Ser. No. 609,747, filed May 14, 1984 now abandoned.

BACKGROUND OF THE INVENTION

It is often necessary to connect or disconnect conductors (or contacts) along one electrical component with corresponding conductors (or contacts) along another electrical component.

Moreover, it is often desired that such connection (or disconnection) be convenient, effective and performable in an area inaccessible by tools.

It is also often desired that connection (or disconnection) be effectuated with a zero insertion (or removal) force. This feature may be required to prevent damage to the components being connected.

In addition, it is typically desired in numerous applications of electrical connectors to provide connection between closely spaced parallel conductors; to provide high strength closure; and high resistance to shock and vibration. Conventional approaches which teach separate coupling elements for each conductor on one component to be connected to a corresponding conductor on a second component have rendered such features difficult to attain.

SUMMARY OF THE INVENTION

In accordance with the invention, an electrical connector is provided which realizes the aforementioned features as objects.

The present invention relates preferably to a multipin electrical connector including (a) male member having a plurality of conductors thereon extending longitudinally in parallel and (b) a female member that includes a split tube to receive the male member. A plurality of parallel conductors on the female member extend along the inside of the split tube which receives the male member. A plurality of parallel conductors on the female member extend along the inside of the split tube are spaced to correspond with the conductors along the male members. The male member has an enlarged edge that is insertable into the split tube so that each conductor along the inside of the split tube faces a corresponding conductor along the enlarged edge of the male member. The split tube comprises Nitinol or some other shape memory material which is biased open (or closed) and which, upon heating to a transition temperature, changes dimensions to disengage (or engage) the inserted male member.

Such a connector features zero insertion force, high strength, close conductor spacing, and high shock resistance. Upon closure, the conductors along the male member contact corresponding conductors along the split tube.

Preferably, the invention pertains to an electrical connector for coupling two strips together. The first strip has a split tube forming one edge thereof, the split of the tube being selectively opened and closed. The second strip is inserted into the split when the tube is open, whereupon the tube may be closed to effect coupling of the two strips.

In accordance with the invention, the second strip may include at least one conductor therealong which is to be coupled to a corresponding conductor along the first strip. Typically, parallel conductors on the upper surface and on the lower surface of the second strip are couplable to corresponding conductors of the first strip by closure of the split tube thereagainst.

In one embodiment, the conductors along the upper surface of the second strip are separate and indpendent from the conductors along the lower surface thereof. Also, conductors along the first strip can similarly be defined with (a) an upper plurality of conductors that can close against conductors along the second strip upper surface and (b) a lower plurality of conductors independent of the upper plurality that can close against conductors along the second strip lower surface. Hence, a double connector is provided wherein a plurality of connections can be effected in an upper plane separately and distinct from connections effected in a lower plane. That is, where x conductors are provided along the upper surface and x conductors are provided along the lower surface of the second strip, 2x connections can be made.

In a second embodiment, conductors along the upper surface of the second strip extend into the conductors along the lower surface. Similarly, the upper plurality of conductors of the first strip may extend into the lower plurality of conductors. This is a single connector embodiment. This arrangement provides an upper area and a lower area of electrical contact for each conductor.

Hybrid embodiments which vary from the above two embodiments—the single connector and double connector—may include maintaining some of the conductors on the upper surface of the second strip independent of the conductors on the lower strip while other conductors on the upper strip extend into conductors on the lower strip.

Also, it is envisioned that all conductors along the upper strip extend into the conductors along the lower strip of the second strip whereas all conductors in the upper plurality of the first strip do not extend into conductors in the lower plurality. Accordingly, two sets of lines connected respectively to the upper plurality of the first strip and to the lower plurality of the first strip may be interconnected upon closure against the second strip, as well as providing connection between the conductors on the first strip and second strip.

In the various embodiments it is contemplated that the split tube include at least a shape memory layer formed, preferably, of a shape memory metal such as a nickel titanium alloy. More specifically, it is preferred that the split tube comprise coaxial layers which include a shape memory layer, a stainless steel layer disposed about the shape memory layer, and a flexible plastic layer—into which conductors are imbedded—enclosing the split tube. Depending on how heat is applied to the shape memory layer, a heater element may be provided adjacent the shape memory layer along the portion of the flexible plastic layer which inscribes the split tube.

To provide a locked coupling, the edge of the second strip inserted into the interior of the split tube is enlarged.

In accordance with the invention, closure of the connector is performed by heating a shape memory layer to a characteristic transition temperature. It is, however, contemplated that opening of the connector may also be performed by heating a shape memory layer to a characteristic transition temperature. It is known that a shape memory metal in its memory shape displays high strength; thus the closure or opening to a memory shape results in a high strength configuration.

DESCRIPTION OF THE INVENTION

Figure 1:
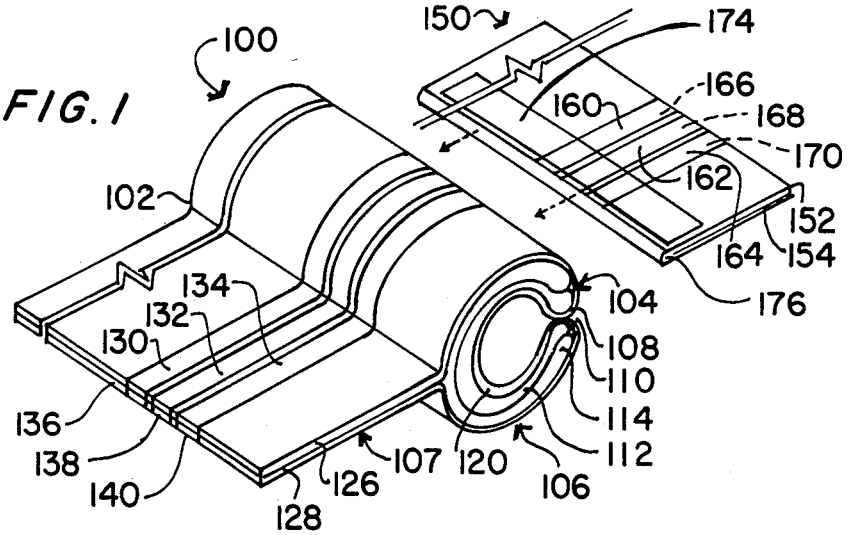
FIG. 1 is an upper back left perspective view illustrating a connector according to the invention.

In FIG. 1, one embodiment of an electrical connector 100 according to the invention is illustrated.

The connector 100 is shown including a first strip 102 which terminates in a split tube 104. The split tube 104 is shown formed of a plurality of coaxial layers. Extending peripherally about the split tube 104 is a flexible plastic layer 106 which serves to inscribe and circumscribe the split tube 104. That is, the flexible plastic layer 106 extends along a flat two-layer portion 107 of the first strip 102, passes circumferentially to an upper lip 108 whereupon the plastic layer 106 traces the inner surface of the split tube 104 to a lower lip 110. From the lower lip 110, the plastic layer 104 follows the lower outer circumference of the split tube 104 back to the flat portion 107 of the first strip 102. The flat portion 107 comprises two plastic layers that lie against each other as a laminate.

The split tube 104 also includes a shape memory layer 112 about which is disposed another layer 114. The layer 114 is preferably stainless steel. The shape memory layer 112 and layer 114 are enclosed by the flexible plastic layer 106.

Provided along the inscribing portion of the flexible plastic layer 106 is a flexible heater 120 of a construction known in the art. The heater 120 is adjacent the shape memory layer 112 to direct heat thereto.

Also provided along the flexible plastic layer 106 are parallel conductors 130, 132, and 134 (the number being variable) along the upper layer 126 of the first strip 102. Along the lower layer 128 of the first strip 102 are parallel conductors 136, 138, and 140. Each conductor 130 through 134 extends along the flat portion 107 to follow an outer circumscribing path toward and around the upper lip 108. Each conductor 136 through 140 follows a similar path along the lower layer 128 of the first strip 102. As discussed below, the conductors 130 through 134 along the upper layer 126 may or may not extend into corresponding conductors 136 through 140 along the lower layer 128 depending on embodiment.

Preferably, the conductors 130 through 140, as well as the heater 120, are embedded in the flexible plastic layer 106 to enhance durability, shock and impact resistance, integrity of structure, and strength and to maintain the relative positions of conductors and heater strips. That is, the conductors 130 through 140 and heater 120 are covered by plastic layer 106. To expose the conductors to permit electrical contact therewith—as by pressing another conductor thereagainst—windows are provided in the plastic layer 106 where contact is to be made. As described below, the windows expose at least those portions of the conductors 130 through 140 along the upper lip 108 and the lower lip 110. The space therebetween, it is noted, defines the split of the tube 104 between which a second strip 150 is insertable.

The second strip 150 includes two flexible plastic layers 152 and 154 lying coextensively against each other. The upper layer 152 has conductors 160 through 164 therealong. The lower layer 154 also has conductors 166 through 170 (not shown) extending therealong. To expose the conductors 160 through 164, a window 174 is provided in the upper layer 152. A similar window is preferably provided in the lower layer 154 also.

The second strip 150 also includes an enlarged edge 176 which is insertable into the interior of the split tube 104. (The edge 176 is enlarged by inserting a rod or the like between the two layers 150 and 152 at the fold therebetween.) By enlarging the edge 176, the two strips 102 and 150 cannot be pulled apart after the split tube 104 is closed with the edge 176 inserted. Specifically, the edge 176 preferably abuts the upper lip 108 and the lower lip 110 upon closure to effectuate the desired locking effect.

The connector 100 in FIG. 1 is shown with the split tube 104 closed. To enable the second strip 150 to be inserted, the split tube 104 is deformed to open the split. In this regard, it is noted that the shape memory layer 112 may serve to either open the tube 104 from a closed position or close the tube 104 from an open position. Whether the shape memory layer 112 acts to open or to close the tube 104 depends on the memory shape imparted to the layer 112. The shape memory layer 112 comprises a material that can be formed to a predefined memory shape or configuration. After the memory shape is defined, the material can be deformed and, by bringing the material to a characteristic transition temperature, returned (or recovered) to the memory shape. Although various plastics feature heat recoverable memory, it is preferred that the shape memory layer 112 be a metal which undergoes transition such as a nickel titanium alloy, or Nitinol.

The operation of Nitinol and other alloys which exhibit such memory or recovery from a heat unstable state is discussed in various references and is not elaborated on here. Reference is made, however, to U.S. Pat. No. 3,606,592 to Madurski et al and to U.S. Pat. No. 4,018,547 to Rogen which describe the shape memory phenomenon and are incorporated herein by reference. In brief, Nitinol has a temperature above which the memory configuration is set. By holding the Nitinol to a given shape at such temperature (e.g. approximately 900° F. for 55-Nitinol), the memory configuration becomes fixed. Nitinol also has a transition temperature range (TTR) below which the alloy is ductile and may be plastically deformed and above which recovery occurs. Raising the alloy to temperatures above the TTR, then, causes atoms of the alloy displaced during deformation to return their predeformed positions. Accordingly, Nitinol and similar alloys characterized with memory shape can be repeatedly deformed and recovered in alternation by applying pressure to the Nitinol when below the TTR and by heating the alloy to recovery temperatures thereafter. As is known in the art, the TTR, or recovery temperatures, may be determined between −60° F. and +300° F. by proper selection of alloy.

In the preferred mode, the shape memory layer 112 acts to open the tube 104. The tube 104 is closed by a spring force provided by the layer 114. The spring force is sufficient to close the tube 104 when the shape memory layer 112 is ductile and soft (below the transition temperature of Nitinol, for example) but is overpowered by the shape memory layer 112 upon recovery thereof. Alternatively, although not preferred, the tube 104 may be deformed closed by means of a tool, if the layer 114 is not desired or provided.

Although the connector 100 may vary greatly in dimensions based on use, sample dimensions include: an outer diameter of 0.120 inches for the tube 104 when closed, a 0.020 inch thickness of layer 112, a 0.015 inch thickness of layer 114, an inner "diameter" of the tube 104 (when open) of 0.022 inch and a plastic layer 106 having dimensions of a conventional flexstrip.

Figure 2:
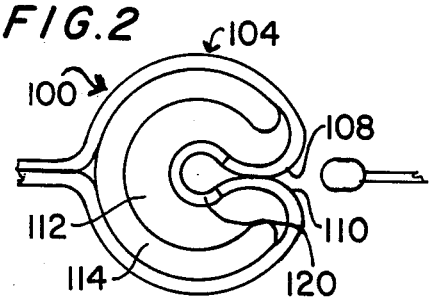
FIGS. 2 through 5 are side-view illustrations showing the operation of the connector of FIG. 1.
Figure 3:
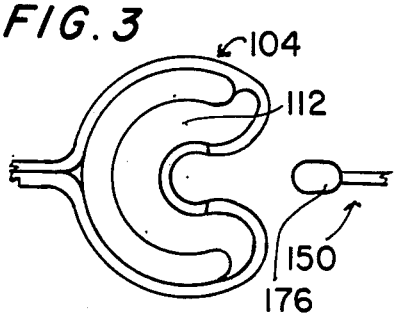
Figure 4:
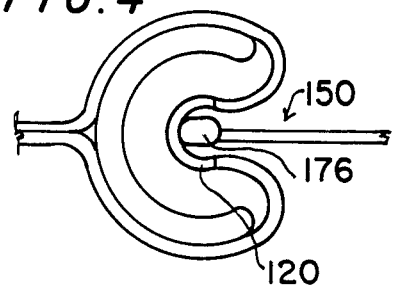
Figure 5:
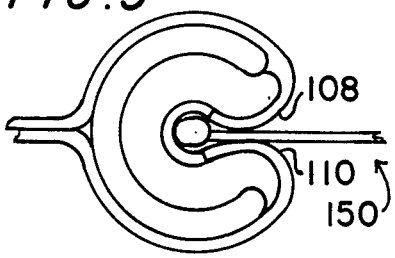

FIGS. 2 through 5 illustrate the operation of the connector 100. In FIG. 2, the connector 100 is closed (by the layer 114) with the upper lip 108 of tube 104 abutting the lower lip 110. In FIG. 3, the tube 104 is opened by heating the shape memory layer 112 to enable the second strip 150 with its enlarged edge 176 to be inserted as shown in FIG. 4. The heating is provided by heater 120. Other sources of heat may also be employed. Discontinuing the heating results in the closure of the upper lip 108 and lower lip 110 with the second strip 150 therebetween. The window 174 (see FIG. 1) of the second strip 150 is aligned with the upper lip 102—and a corresponding window along the lower layer 154 (see FIG. 1) is also aligned with the lower lip 110 following insertion and closure. By providing windows along the upper lip 108, the conductors 130 through 134 are pressed against the conductors 160 through 164, respectively, making electrical contact therewith. Similarly, by providing windows along the lower lip 110, the conductors 136 through 140 are pressed against the conductors 166 through 170, respectively, making electrical contact therewith.

Figure 6:
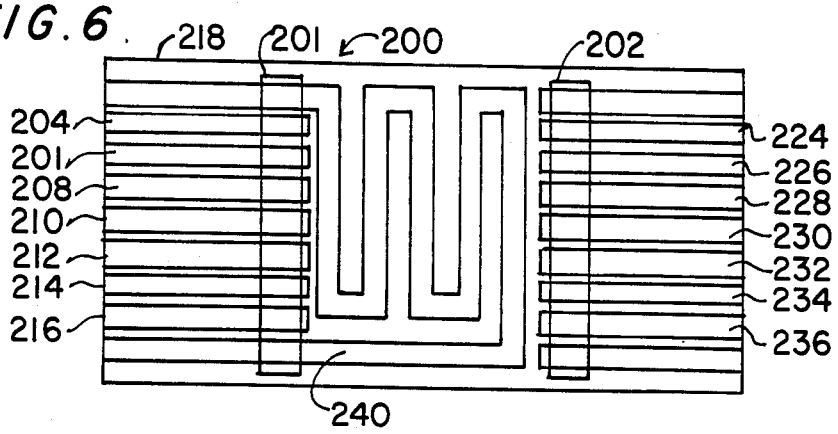
FIG. 6 is an illustration of one embodiment of an element formable into a first strip shown in FIG. 1.

In FIG. 6, one embodiment of a first strip 200 is shown before it is structured as in FIG. 1. FIG. 6 shows two windows 201 and 202 which lie along the upper lip 108 and the lower lip 110, respectively, when formed as FIG. 1. Connectors 204 through 216 are embedded in flexible plastic 218. These conductors 204 through 216 may be considered to lie along the "upper" layer of the first strip as illustrated in FIG. 1. The conductors 204 through 216 end just beyond the window 201. Conductors 224 through 236 similarly end just beyond the window 202. Also embedded in the plastic 218 is a heater element 240 with leads connectable thereto to produce heating.

Figure 7:
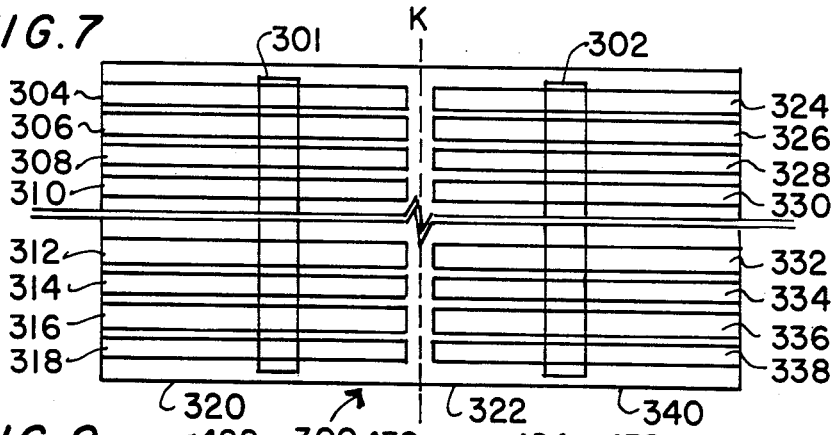
FIG. 7 is an illustration of one embodiment of an element formable into a second strip shown in FIG. 1.

FIG. 7 shows an embodiment of the second strip 300 formable into a structure like that shown in FIG. 1 by folding along line K. One window 301 is shown exposing conductors 304 through 318 embedded in the "upper" layer 320 of plastic 322. Conductors 324 through 338 are provided in the "lower" layer 340 being exposed through window 302.

Figure 8:
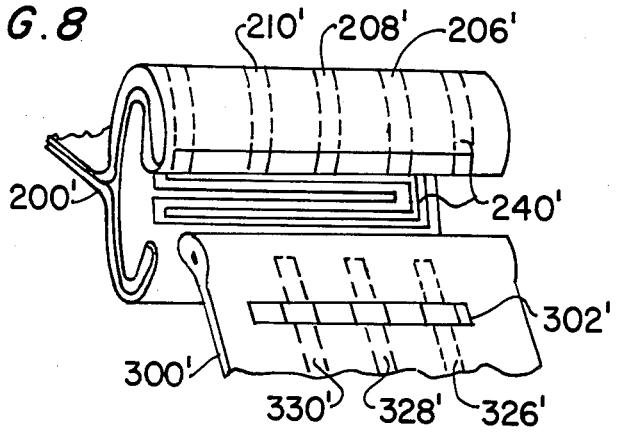
FIG. 8 is an upper front left perspective view of a double connector formed from the first strip of FIG. 6 and the second strip of FIG. 7.

FIG. 8 shows a perspective of a connector formed from a first strip 200 as in FIG. 6 and the second strip 300 as in FIG. 7. FIG. 8 shows a double connector wherein conductors 206' through 210' are separate from—i.e. do not extend into—conductors along the lower plane, e.g. conductors 224 through 236 of FIG. 6, and wherein conductors 308' through 312' do not extend into conductors along the lower plane such as conductors 324 through 338 of FIG. 7. Accordingly, six conductors (as illustrated) of the first strip 200' can separately and distinctly connect to six conductors of the second strip 300'. That is, there is an upper plane of connections that can be made (by pairs 206'-326', 208'-328', 210'-330') and a similar lower plane of connections that can be made.

Figure 9:
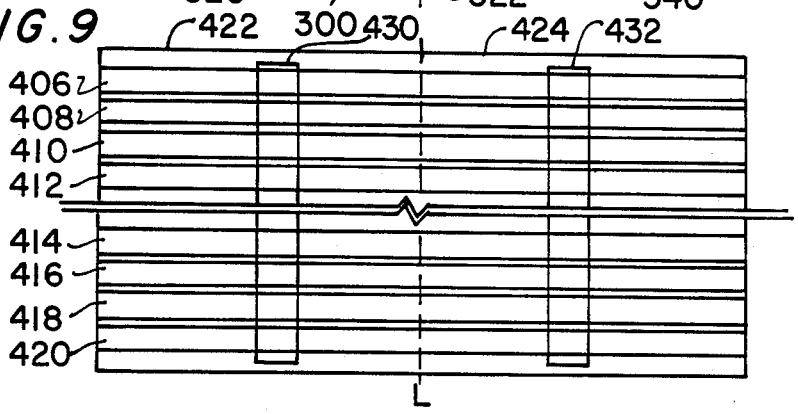
FIG. 9 is an alternative embodiment of an element formable into a second strip shown in FIG. 1.

Turning to FIG. 9, a second strip 400 for use in a single connector is shown. Specifically, each conductor 406 through 420 in the upper layer 422 folds back to extend along the lower layer 424 when the second strip 400 is creased along line L—L. In the single connector, each conductor of the first strip (not shown) also extends the length of the plastic—each conductor 406 through 420 being exposed through both windows 430 and 432 to make electrical contact with a corresponding conductor of the first strip.

Hybrid embodiments which vary from the above two embodiments—the single connector and double connector—may include maintaining some of the conductors on the upper surface of the second strip while other conductors on the upper strip extend into conductors on the lower strip.

Also, it is envisioned that all conductors along the upper strip extend into the conductors along the lower strip of the second strip whereas all conductors in the upper plurality of the first strip do not extend into conductors in the lower plurality. Accordingly, two pairs of lines connected respectively, to the upper plurality of the first strip and to the lower plurality of the first strip may be interconnected upon closure against the second strip, as well as providing connection between the conductors on the first strip and second strip.

Figure 10:
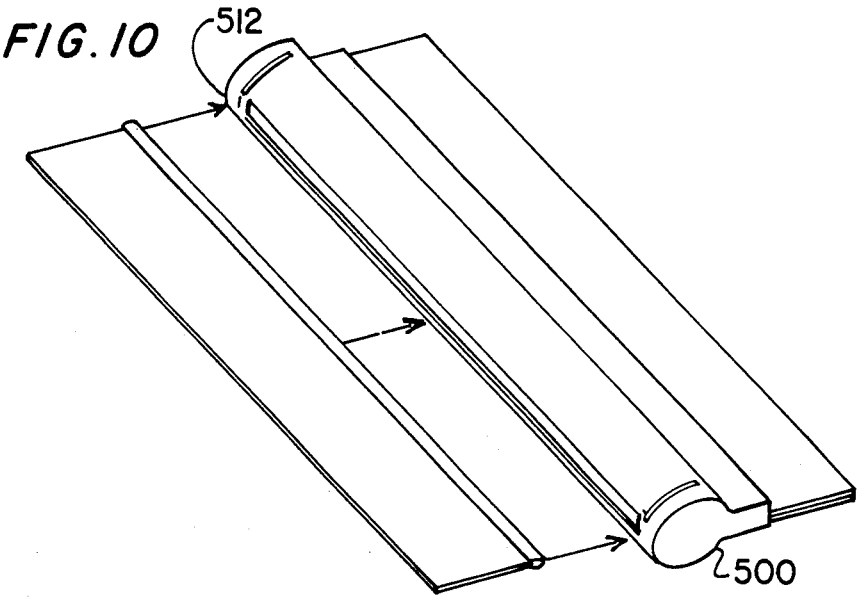
FIGS. 10 and 11 are perspective and side view illustration of the invention including a cover.
Figure 11:
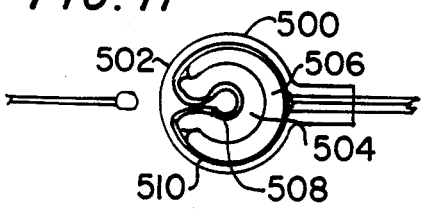

In FIGS. 10 and 11, a cover 500 is shown enclosing a tube 502 with shape memory layer 504, stainless steel layer 506, heater 508, and plastic layer 510. The cover 500 has a slot 512 for receiving the second strip 514 with a locking edge 516.

According to the invention, conductors along the first strip engaging corresponding conductors along the second strip to make electrical contact therewith. When the conductors are embedded in, or covered by, plastic windows are required to enable the contact. If the conductors lie along or protrude from the plastic rather than being embedded totally within, the windows may not be required.

I claim:

1. An electrical connector comprising:

a first strip having an axially elongated hollow split tube having an axially aligned split therein to receive a substrate forming one edge thereof;

a heat recoverable member being a concentric layered portion of said tube to change the radial dimensions of said split, said member formed from shape memory metal having a deformable state below a transition temperature and a memory state above the transition temperature, said member capable of being deformed when said metal is in its deformable state corresponding to one dimension of the split, a change from its deformable state to its memory state recovering said member to its non-deformed shape corresponding to another dimension of the split;

spring means also being a concentric layered portion of said tube in operative co-axial contact with said heat-recoverable member, said spring means and said heat-recoverable member providing unobstructed access to the axis of said hollow split tube to a substrate that may be inserted therein, said spring means contacting and exerting a radial force against said heat-recoverable member to deform said heat-recoverable member when said metal is in its deformable state, said heat-recoverable member capable of overcoming said force when said metal is changed from its deformable state to its memory state, recovering to its non-deformed shape to change the dimension of said split; and a plurality of parallel spaced conductors extending along said first strip and extending generally perpendicular to the axis of said split tube and exposed along the inner surface of said split tube, said conductors terminating at a plurality of corresponding contacts, said contacts capable of making electrical contact with the substrate that may be inserted in the split of said split tube.

2. An electrical connector according to claim 1 wherein said strip includes a cover-layer into which the conductors are embedded said cover layers having contact exposing windows therein to enable said contacts to be exposed.

3. An electrical connector according to claim 1 wherein said shape-memory metal comprises a nickel-titanium alloy.

4. An electrical connector according to claim 1 wherein said spring means is concentric about said heat-recoverable member, said spring means exerting a radially inward force against said heat recoverable member to deform said heat-recoverable member when said metal is in its deformable state corresponding to a closed dimension of the split, said heat recoverable member capable of overcoming said force when said metal is changed from its deformable state to its memory state, recovering to its non-deformed shape to open said split.

5. An electrical connector according to claim 4 further including a heater positioned adjacent to said heat recoverable member, said heater capable of transferring sufficient heat to said heat-recoverable member to elevate the temperature thereof above said transition temperature.

6. An electrical connector according to claim 4 wherein said shape-memory metal comprises a nickel-titanium alloy.

7. An electrical connector according to claim 4 further including a second strip capable of being inserted into the split of said split tube when open, said second strip having a plurality of parallel spaced conductors extending along said second strip, said conductors terminating at a plurality of corresponding contacts, said contacts of said second strip being electrically connectable to said contacts of said first strip upon recovery of said heat-recoverable member to its non-deformed shape.

8. An electrical connector according to claim 7 wherein said second strip has an enlarged edge, said enlarged edge capable of being disposed within said split tube when said second tube is inserted therein, said enlarged edge locking said second strip to said split tube upon closure thereof.

9. An electrical connector according to claim 7 wherein said first and second strips each incude a cover-layer into which the conductors are embedded, said cover-layers having contact exposing windows therein to enable said contacts to be exposed.

10. An electrical connector according to claim 7 wherein said first strip has an upper surface along which a first plurality of said parallel conductors extend, the conductors of said first plurality terminating at a first plurality of corresponding contacts exposed to the interior of said split tube;

wherein said first strip has a lower surface along which a second plurality of said parallel conductors extend, the conductors of said second plurality terminating at a second plurality of corresponding contacts exposed to the interior of said split tube;

wherein said second strip has an upper surface along which a third plurality of said parallel conductors extend, the conductors of said third plurality trerminating at a third plurality of corresponding contacts each of which is capable of pressing against a corresponding contact of said first plurality of corresponding contacts in response to closure of said split tube; and wherein said second strip has a lower surface along which a fourth plurality of said conductors extend, the conductors of said fourth plurality terminating at a fourth plurality of corresponding contacts, each of which is capable of pressing against a corresponding contact of said second plurality of corresponding contacts in response to closure of said split tube.

11. An electrical connector according to claim 10 wherein said second strip has an enlarged edge, said enlarged edge capable of being disposed within said split tube when said second tube is inserted therein, said enlarged edge locking said second strip to said split tube upon closure thereof.

* * * * *

UNITED STATES PATENT AND TRADEMARK OFFICE

CERTIFICATE OF CORRECTION

PATENT NO. : 4,621,882

DATED : November 11, 1986

INVENTOR(S) : John F. Krumme

It is certified that error appears in the above-identified patent and that said Letters Patent is hereby corrected as shown below:

Column 7, line 17 "e1ectrical" should be -- electrical --.

Column 8, line 29 "trer-" should be -- ter- --.

Signed and Sealed this

Twenty-fourth Day of February, 1987

*Attest:*

DONALD J. QUIGG

*Attesting Officer*

*Commissioner of Patents and Trademarks*